United States Patent [19]

Oba

[11] Patent Number: 4,698,465

[45] Date of Patent: Oct. 6, 1987

[54] SWITCH

[75] Inventor: Hiroki Oba, Furukawa, Japan

[73] Assignee: Alps Electric Co., Ltd., Japan

[21] Appl. No.: 920,843

[22] Filed: Oct. 17, 1986

[30] Foreign Application Priority Data

Oct. 21, 1985 [JP] Japan ..... 60-159895[U]

[51] Int. Cl.[4] ..... H01H 1/12; H01H 13/52; H01H 15/02

[52] U.S. Cl. ..... 200/16 F; 200/159 R; 200/276

[58] Field of Search ..... 200/6 R, 16 F, 159 R, 200/254, 276

[56] References Cited

U.S. PATENT DOCUMENTS 1,333,115 3/1920 Jones ..... 200/159 R 4,092,503 5/1978 Raeder ..... 200/276 X 4,488,018 12/1984 Hayashida ..... 200/6 R

*Primary Examiner*—J. R. Scott

*Attorney, Agent, or Firm*—Guy W. Shoup

[57] ABSTRACT

A switch comprising a first contact leading to one terminal, a second contact in the form of a coil spring leading to the other terminal via a receiving plate with an elongate protuberance, a wafer receiving the first and second contacts, a case mounted on the wafer so as to cover an opening thereof, and a slide reciprocably received through an guide hole of the case for bringing one end portion of the second contact into and out of engagement with the first contact. The other end of the second contact extends substantially parallel to the protuberance and is disposed against the receiving plate so as to be engageable with the protuberance.

3 Claims, 8 Drawing Figures

SWITCH

BACKGROUND OF THE INVENTION

1. Field of the Invention

The present invention relates to a switch in which switching takes place by pressing a slide longitudinally, and more particularly to a small-sized switch of a so-called mechanically operable type for use chiefly in switching in response to movement of parts in a system.

2. Description of the Prior Art

FIGS. 5 through 8 illustrate a conventional switch of the type described. As shown in FIG. 5, the conventional switch generally comprises a wafer 3 with a pair of terminals 1, 2 projecting from its lower side, a case 4 mounted on the wafer so as to cover an upper opening thereof, and a slide 6 received through a guide hole 5 of the case 4.

A spring contact 7 in the form of a coil spring leads to one of the terminals 1 via a receiving plate 10 of conductive metal having an elongate protuberance 10*a* for supporting the spring contact 7, while a fixed contact 8 in the form of a clip leads to the other terminal 2. The slide 6 is vertically reciprocably received through the guide hole 5 of the case 4 with its one end abutting against an abutment portion 7*a* of the spring contact 7 so that the slide 6 is normally urged upwardly by the resilience of the spring contact 7. The wafer 3 is generally in the form of a molded box within which the receiving plate 10 and the fixed contact are disposed. The case 4 is mounted on the opening side of the wafer 3; thus the wafer 3 and the case 4 are unitarized. Consequently, a coil portion 7*c* of the spring contact 7 is held against the elongate protuberance 10*a* of the receiving plate 10 by a pair of parallel projections 4*d*, 4*d* extending from the top plate 4*e* of the case 4 toward the wafer 3, with a contact portion 7*b* of the contact 7 loosely received through the space between the two projections 4*d*, 4*d*, and with the opposite end of contact 7 held in predetermined position of the wafer 3.

A mounting portion 4*a* of the case 4 has in its opposite ends a pair of grooves 4*b*, 4*b* in which a pair of projections 3*a*, 3*a* formed on opposite ends of the wafer 3 is respectively engageable. Owing to the resilience of the case 4 itself, these two projections 3*a*, 3*a* are prevented from removal out of the respective grooves 4*b*, 4*b* except when it is factitiously dismounted. Designated at 4*f* is a mounting hole for use in attaching the switch to a panel, for example, and designated at 5*a* is a generally rectangular land defining the guide hole 5.

As is apparent from FIG. 6, a lower end or pressing portion 6*a* of the slide 6 abuts against the abutting portion 7*a* of the spring contact 7. When the slide 6 is depressed in the direction of an arrow A, the abutting portion 7*a* is moved to a lower or receiving portion 3*b* of the wafer 3 commensurately with the amount of movement of the slide 6. At that time, the contact portion 7*b* of the spring contact 7, which portion is disposed in substantially parallel relation to the pressing portion 6*a* of the slide 6, is brought into engagement with the contact 8 as the contact portion 7*b* is slidably gripped by a clip-like portion 8*a* of the contact 8, thus causing a conductive coupling between the spring contact 7 and the second terminal 2. As a result the circuit has been closed.

When the pressing force is released from the slide 6, the abutting portion 7*a* of the spring contact 7 is angularly moved in the direction of an arrow B in FIG. 7 by the resilience of the coil portion 7*c* of the spring contact 7, and the slide 6 returns to its original or upper position in the direction of an arrow C. This returning of the slide 6 causes the abutting portion 7*a* of the spring contact 7 to return to its original position, thus bringing the contact portion 7*b* out of contact with the clip portion 8*a* of the contact 8. As a result the circuit has been opened.

If the thus constructed switch is placed adjacent to one of various movable parts of a system so that the slide 6 is movable in response to movement of the one part, it is possible to detect the position of the one part and then to switch movements of the related parts.

However, the amount of force at which the coil portion 7*c* of the spring contact 7 is gripped between the projection 4*d* of the case 4 and the protuberance 10*a* of the receiving plate 10, must be not so great so as not to impair the resiliency of the coil portion 7*c*. This type of switch, which is ordinarily very small-sized in connection with the associated parts, is subject to inaccurate positioning of the spring contact 7 due to even a small dimensional error. For this reason, when the slide 6 is depressed to move the abutting portion 7*a* of the spring contact 7 to the receiving portion 3*b* of the wafer 3, the coil portion 7*c* of the spring contact 7 is angularly raised away from the elongated protuberance 10*a* of the receiving plate 10 in the direction of an arrow D in FIG. 7 with the other end of the spring contact 7 (opposite to the abutting portion 7*a* and the contact portion 7*b*) as a fulcrum, thus causing only a poor engagement between the spring contact 7 and the receiving plate 10. With this conventional switch, accurate and reliable switching operation is difficult to achieve.

SUMMARY OF THE INVENTION

It is therefore an object of the present invention to provide a reliable switch which is free from a poor engagement between a spring contact and a receiving plate of metal to provide a conductive coupling of the spring contact with a terminal.

According to the present invention, there is provided a switch comprising a first contact leading to one of a pair of terminals, a second contact in the form of a coil spring leading to the other terminal via a receiving plate having an elongate protuberance, a wafer receiving the first and second contacts and having an opening, a case mounted on the wafer so as to cover the opening and having a guide hole, and a slide received through the guide hole and reciprocable therethrough for bringing one end portion of the second contact into and out of engagement with the first contact, the other end portion of the second contact extending substantially parallel to the elongate protuberance of the receiving plate and being disposed against the receiving plate so as to be engageable with the elongate protuberance.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF PREFERRED EMBODIMENT

Figure 1:
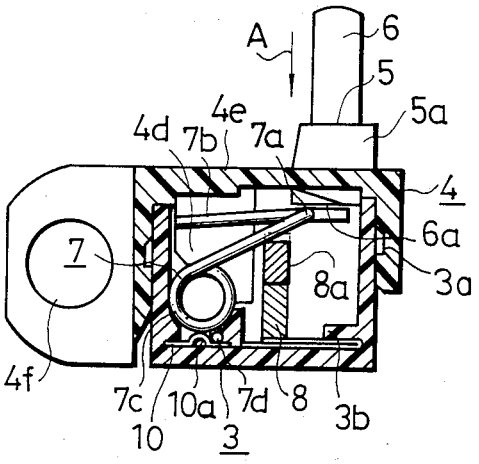
FIG. 1 is a side elevational view, partially in cross section, of a switch embodying the present invention, showing the switch in "off" position.

Like reference numerals designate similar parts throughout various views.

Figure 2:
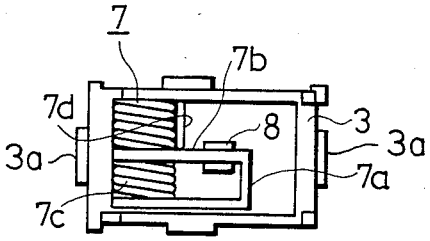
FIG. 2 is a plan view of FIG. 1, showing the interior of a wafer.
Figure 3:
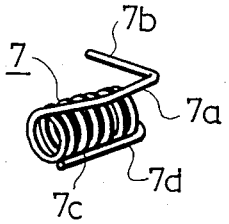
FIG. 3 is a perspective view of a spring contact.

The principles of the present invention are particularly useful when embodied in a switch such as shown in FIGS. 1 and 2.

The switch generally comprises a substantially box-shaped molded wafer 3 in which a receiving plate 10 of conductive metal and a first contact 8 is fixedly mounted. A second contact 7 in the form of a coil spring is received in the wafer 3 in a manner described below. The receiving plate 10 and the first contact 8 lead to a pair of terminals (not shown), respectively. The receiving plate 10 has an elongate protuberance 10*a* on which a coil portion 7*c* of the second contact 7 is disposed. A case 4 is mounted on the wafer 3 so as to cover an opening thereof, and has a guide hole 5 through which a slide 6 is vertically reciprocably received. As the wafer 3 and the case 4 are thus joined together, the coil portion 7*c* of the spring contact 7 is pressed against the elongate protuberance 10*a* of the receiving plate 10 by a pair of parallel projections 4*d*, 4*d* extending from an upper plate 4*e* of the case 4 toward the wafer 3, and a lower or pressing portion 6*a* of the slide 6 abuts against an abutting portion of the spring contact 7 so as to be normally urged upwardly in FIG. 1 by the resilience of the spring contact 7. The spring contact 7 has a contact portion 7*b* contiguous to the abutting portion 7*a*. The end portion 7*d* of the spring contact 7 which portion is remote from and opposite to the abutting portion 7*a* and the contact portion 7*b*, is bent so as to extend in substantially parallel relation to the axis of the coil portion 7*c*. As the wafer 3 and the case 4 are assembled together, the spring contact 7 is placed in the wafer 3 with the end portion 7*d* disposed against the receiving plate 10 adjacent to the elongate protuberance 10*a* thereof.

In operation, when the slide 6 is depressed in the direction of an arrow A in FIG. 1, the abutting portion 7*a* of the spring contact 7, which portion is disposed against the pressing portion 6*a* of the slide 6, is moved to a lower or receiving portion 3*b* of the wafer 3, commensurately with the amount of movement of the slide 6, and in the meantime, the contact portion 7*b* is brought into engagement with the contact 8 as the contact portion 7*b* is slidably gripped by a clip-like portion 8*a* of the contact 8, thus closing the circuit. At that time, in response to angular movement of the abutting portion 7*a* toward the receiving portion 3*b* of the wafer 3, the end portion 7*d* of the spring contact 7 is moved into engagement with the elongate protuberance 10*a* on the receiving plate 10 by the resilience of the coil portion 7*c*. Therefore, even if the coil portion 7*c* is spaced from the elongate protuberance 10a, no poor engagement between the spring contact 7 and the receiving plate 10 would occur. In other words, when the coil portion 7*c* is raised in the direction of an arrow D in FIG. 4 as the slide 6 is depressed, the spring contact end 7*d* necessarily engages the elongate protuberance 10*a* of the receiving plate 10, thus keeping the spring contact 7 in contact with the receiving plate 10, irrespective of some dimensional error.

Figure 4:
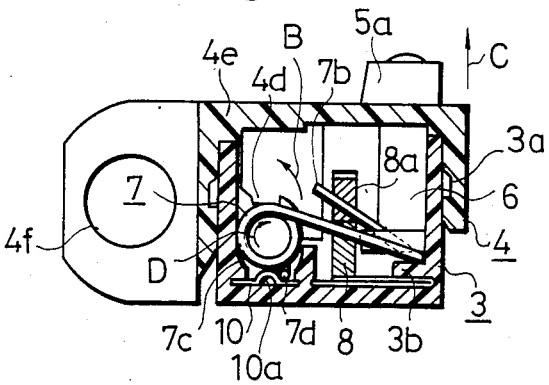
FIG. 4 is a view similar to FIG. 1, but showing the switch in "on" position.
Figure 5:
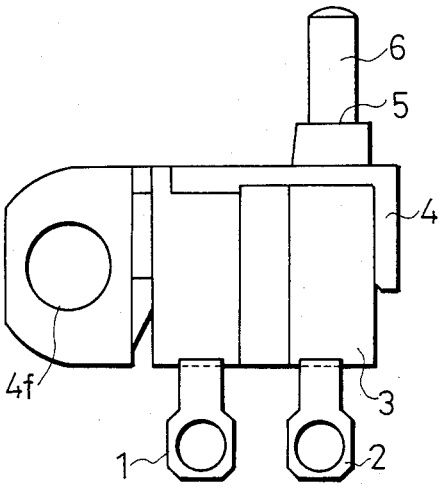
Fig. 5 PRIOR ART
FIG. 5 is a side elevational view of a conventional switch.
Figure 6:
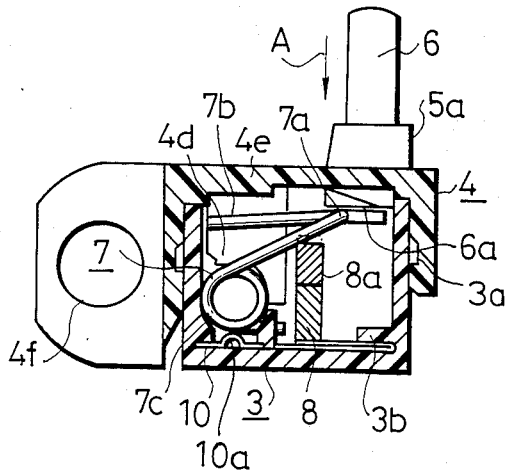
Fig. 6 PRIOR ART
FIG. 6 is a side elevational view, partially cross section, of FIG. 5, showing the conventional switch in "off" position.
Figure 7:
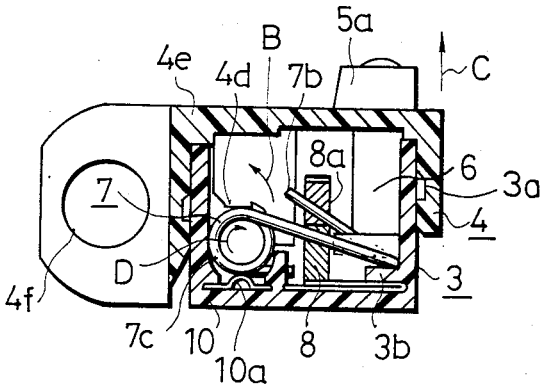
Fig. 7 PRIOR ART
FIG. 7 is a view similar to FIG. 6, but showing the conventional switch in "on" position.
Figure 8:
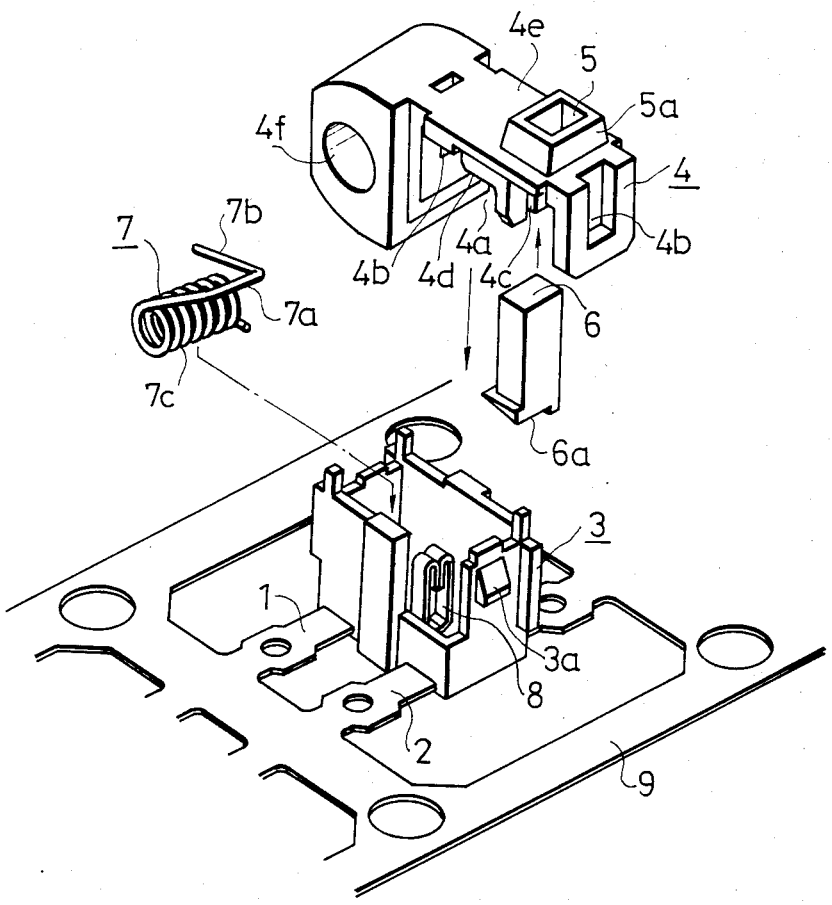
Fig. 8 PRIOR ART
FIG. 8 is an exploded perspective view of the conventional switch, showing the manner in which the switch is assembled.

When the pressing force is released from the slide 6 in FIG. 4, the abutting portion 7*a* of the spring contact 7 is angularly moved in the direction of an arrow B by the resilience of the coil portion 7*c* of the spring contact 7, and the slide 6 returns to its original or upper position in the direction of an arrow C. This returning of the slide 6 causes the abutting portion 7*a* of the spring contact 7 to return to its original position, thus bringing the contact portion 7*b* out of contact with the clip portion 8*a* of the contact 8. As a result the circuit has been opened.

The other parts of the present switch are similar to the corresponding parts of the conventional switch discussed in connection with FIGS. 5 through 8, and hence their description is omitted here for clarity.

As mentioned above, according to the present invention, the end portion remote from and opposite to the abutting portion and the contact portion of the spring contact extends in substantially parallel to the elongate protuberance of the receiving plate of metal and this end portion is disposed against the receiving plate adjacent to the elongate protuberance so as to be engageable therewith. With this arrangement, even if the coil portion of the spring contact is spaced from the elongate protuberance, the spring contact end portion is engageable with the protuberance as the abutting portion is lowered by the slide, thus not only making the switch free from poor engagement between the spring contact and the receiving plate, but also causing an improved reliability. Further, since some dimensional error is allowable, it is possible to manufacture the switch easily with reduced cost.

It will be understood that various changes in the details, material, and arrangements of parts, which have been herein described and illustrated in order to explain the nature of the invention, may be made by those skilled in the art within the principle and scope of the invention as expressed in the appended claims.

What is claimed is:

1. A switch comprising:

(a) a lower housing having a bottom wall and side walls defining an internal space therein;

(b) an upper casing having a guide hole in one part thereof mounted over said housing to enclose said internal space, said housing and casing being made of insulative material;

(c) a conductive plate mounted on one part of said bottom wall in said internal space of said housing having an elongated protuberance projecting upwardly along an upper surface of said plate;

(d) a first conductive contact mounted in said internal space of said housing spaced apart from said plate;

(e) a second conductive contact in the form of a coil spring placed on the upper surface of said plate, said coil spring having one end portion extending toward said first contact, and its other end portion extending substantially parallel to said protuberance of said plate and being disposed against said plate so as to abut against said protuberance and hold said coil spring in place when an actuation force is applied on said one end portion of said coil spring;

(f) a pair of terminals each connected with a respective one of said plate and said first contact and having ends extending externally from said housing; and (g) a slide member received through said guide hole of said upper casing and reciprocable therethrough and having one end abutting said one end portion of said coil spring for bringing it into and out of conductive contact with said first contact upon actuation of said slide member.

2. A switch according to claim 1, wherein said second contact has a coil portion disposed on and along said elongate protuberance, and wherein said other end of said second contact is substantially parallel to the axis of said coil portion.

3. A switch according to claim 2, wherein said other end portion of said second contact extends from one end of said coil portion toward and terminates short of the other end of said coil portion.

* * * * *